US005974291A

United States Patent [19]

Yamaguchi

[11] Patent Number: 5,974,291

[45] Date of Patent: Oct. 26, 1999

[54] IMAGE FORMING APPARATUS AND IMAGE FORMING METHOD USING SELECTIVE EXPOSURE AND REMOVAL OF LIQUID DEVELOPER

[75] Inventor: Chiseki Yamaguchi, Tokyo, Japan

[73] Assignee: NEC Corporation, Tokyo, Japan

[21] Appl. No.: 08/991,771

[22] Filed: Dec. 16, 1997

[30] Foreign Application Priority Data

Dec. 16, 1996 [JP] Japan ..... 8-335954

[51] Int. Cl.[6] ..... G03G 15/11

[52] U.S. Cl. ..... 399/237; 399/134; 399/152

[58] Field of Search ..... 399/233, 237, 399/249, 134, 151–152, 223; 430/117–119

[56] References Cited

U.S. PATENT DOCUMENTS

| | | | |
|---|---|---|---|
| 3,924,945 | 12/1975 | Weigl | 430/237 X |
| 5,023,665 | 6/1991 | Gundlach | 355/256 |
| 5,053,821 | 10/1991 | Kunugi et al. | 399/134 |
| 5,424,811 | 6/1995 | Haneda | 399/270 |
| 5,504,564 | 4/1996 | Snelling et al. | 399/151 |
| 5,532,796 | 7/1996 | Narikawa et al. | 399/152 |
| 5,537,199 | 7/1996 | Takai et al. | 347/115 |
| 5,557,377 | 9/1996 | Loewen et al. | 399/249 X |
| 5,737,671 | 4/1998 | Watanabe | 399/159 |

FOREIGN PATENT DOCUMENTS

| | | |
|---|---|---|
| 1-265266 | 10/1989 | Japan . |
| 2-277086 | 11/1990 | Japan . |
| 2-306275 | 12/1990 | Japan . |
| 3-31880 | 2/1991 | Japan . |
| 4-233566 | 8/1992 | Japan . |
| 5-188762 | 7/1993 | Japan . |
| 6-214466 | 8/1994 | Japan . |
| 8-179601 | 7/1996 | Japan . |
| 9-244418 | 9/1997 | Japan . |

*Primary Examiner*—Arthur T. Grimley
*Assistant Examiner*—Quana Grainger
*Attorney, Agent, or Firm*—Foley & Lardner

[57] ABSTRACT

In an image forming apparatus, a supply roller 4 supplies a liquid developer to the photo-conductive substance of a photosensitive drum or belt prior to an electrostatic latent image forming process. The supply roller 4 is applied with a voltage dentical in polarity with the charge of toner in the liquid developer, and the liquid developer is uniformly supplied to the surface of a photo-conductive substance to form a liquid developer layer. An exposure unit 6 selectively exposes the photo-conductive substance from the upside of the liquid developer layer in accordance with the image information, to thereby weaken an adhesion of the toner in an exposed area of the liquid developer to the photo-conductive substance. A removing roller 8 is applied with a voltage opposite in polarity to the toner charge to attract and recover the toner weakened in the adhesion by an electric field. The developed image caused by the liquid developer which has remained on the surface of the photo-conductive substance without being recovered is transferred to a recording medium 11 by a transfer roller 13.

12 Claims, 4 Drawing Sheets

IMAGE FORMING APPARATUS AND IMAGE FORMING METHOD USING SELECTIVE EXPOSURE AND REMOVAL OF LIQUID DEVELOPER

BACKGROUND OF THE INVENTION

1. Field of the Invention

The present invention relates to an image forming apparatus and an image forming method using a liquid developer and a photo-conductive substance.

2. Description of the Related Art

A conventional image forming apparatus using a liquid developer electrostatically or magnetically forms a latent image on a surface of an imiage forming body using a photoreceptor or a dielectric substance which are photosensitive substances, or an image forming body such as a magnetic recording body, and then selectively adheres the liquid developer onto the latent image to develop the image. The image forming apparatus then transfers an image of the liquid developer (developed image) which has been developed on the surface of the image forming boy onto a recording sheet, and thereafter fixes the developed image as transferred on the recording sheet by heat. With this process, image formation is completed.

In the image forming apparatus of this type, there is used a developing unit for supplying the liquid developer to the image forming body on which the latent image has been formed to form the developed image. An example of the conventional developing mant of this type will be described. A developing unit which is disclosed in Japanese Patent Unexamined Publication No. Hei 2-306275 published in Dec. 19, 1990 supplies the liquid developer to a developing roller through a supply roller prom a vessel in which the liquid developer is accommodated to remove a surplus developer by a squeeze roller. A developing unit which is disclosed in Japanese Patent Urexamined Publication No. Hei 6-214466 published in Aug. 5, 1994 makes a photo-conductive substance mosve while a liquid toner vessel, a developing roller and a squeege roller ate brought close to a surface of the photo-conductive substance on which an electrostatic latent image has been formed in the stated order, to thereby form the electrostatic image into a visual image through a liquid toner.

Also, a developing unit which is disclosed in Japanese Patent Unexamined Publication No. Hei 2-277086 published in Nov. 13, 1990 includes a supply slit that is disposed opposite to an image forming body on which an electrostatic latent image has been formed and erects a liquid toner toward the image forming body, and a recovery slit that recovers a supply toner. Further, a developing unit which is disclosed in Japanese Patent Unexamined Publication No. Hei 4-233566 published in Aug. 21, 1992 includes a vacuum device for recovering an air and a liquid carrier which is disposed tightly close to a surface of a photo-conductive member with a gap therebetween before a developed image is transferred onto a sheet after an electrostatic latent image formed on the photo-conductive member has been developed by a liquid developer.

In the developing units of the conventional image forming apparatuses as described above, the liquid developer is selectively supplied toward the latent image in accordance with the electrostatic latent image which is formed prior to development, to thereby permit an image section to which the liquid developer is adhered and a non-image section to which no liquid developer is adhered to be formed. The conventional developing units of this type must be designed in such a imanner that a liquid toner (liquid developer) of the quantity with which a sufficient image density is obtained is supplied to the image section, but the liquid toner is not supplied to the non-image section for preventing an image noise from occurring. Thus, because the liquid developer must be selectively supplied, the conventional developing units get complicated in construction. Also, as disclosed in Japanese Patent Unexamined Publication No. Hei 4-233566, there is required an image noose evading unit such as She vacuum unit for recovering the surplus liquid toner after development with the result that a complication is more increased.

The use of the image noise evading unit makes not only the construction of the un.it complicated but also the size of the unit increase, which causes to the costs to be increased and the reliability to be lowered. On the other hand, in the case of using a dielectric substance for the image forming body, a latent image can be formed through one process by a linear electrostatic head, whereas in the case of using a photo-conductive substance such a photoreceptor, there is required a process for uniformly charging the photo-conductive substance before light exposure.

Further, the image -Lorming apparatus normally requires a cleaning section that cleans the surface of the image forming body in order to recycle an image carrier, and also as occasions demand, requires a removal section. Therefore, such an image forming apparatus is not economical in practical use.

SUMMARY OF THE INVENTION

The present invention has been made to solve the above problems, and therefore an object of the present invention is to provide an imiage forming apparatus and an image forming method using a liquid develope having a completely novel image forming process with a reliability.

In order to achieve the above object, according to the present invention, there is provided an image forming apparatus comprising: a photo-conductive substance; a supply device for uniformly supplying a liquid developer onto a surface of the photo-conductive substance; a latent image forming unit for selectively exposing the photo-conductive substance after supply of the liquid developer to form an electrostatic image which is weakened in adhesion of the liquid developer to the photo-conductive substance after exposure; and a selective removing device for removing the liquid developer which is weakened in adhesion from the surface of the photo-conductive substance due to an electric field. The image forming apparatus also includes a transfer device for transferring an image developed by the liquid developer which remains on the surface of the photo-conductive substance after removing of the liquid developer by the recovery device to a recording medium.

According to the present invention, since the supply device supplies the liquid developer to a photosensitive drum or a belt-shaped photo-conductive substance prior to a process for forming an electrostatic latent image, it is unnecessary to selectively supply the licraid developer in accordance with the electrostatic latent image as in the conventional apparatus. Accordingly, with a simple mechanism in which the developer supply section is brought in direct contact with or close to the photo-conductive substance, uniform charge and uniform supply of the liquid developer are enabled, thereby being capable of simplifying the construction of the apparatus. Also, image noises occurring when uniformly supplying the liquid developer can be reduced. This is because in the present invention, an image section to which the liquid developer is adhered is formed by exposure after uniform supply of the liquid developer, and the accuracy (developing degree) of the image section is not determined by the supply device but by the exposure unit. In general, in the developing unit employing the liquid developer, since it is difficult to enhance the accuracy of a developer supply section that supplies the liquid developer to the photo-conductive substance, it is effective that the developed image is formed by the exposure unit which is high in accuracy as in the present invention.

The image forming apparatus according to the present invention further includes a removal device for removing from the surface of the photo-conductive substance the liquid developer that has remained on the surface of the photo-conductive substance after transfer of the image.

The supply device may also serve as the removal device.

The, recovering device has a path through which the liquid developer as recovered is returned to the supply device, thereby being capable of recycling the developer.

Specifically, the supply device includes a accommodating vessel for accomunodating the liquid developer, a supply roller that rotates while being abutted against the photo-conductive substance, and a circuit for applying a voltage identical in polarity with the charge of toner contained in the liquid developer to the supply roller.

The selective removing device includes a removing roller that attracts and recovers the liquid developer whrich is located at a position corresponding to the electrostatic latent image on the photo-conductive substance due to an electric field, a circuit for applying a voltage opposite in polarity to the charge of the toner to the removing roller, and a recovery vessel for accumulating the liquid developer attracted by the removina roller. The accommodating vessel of the supply device and the recovery vessel of the selective removing device are coupled to each other so that the liquid developer as recovered is returned to the accommodating vessel.

Further, according to the present invention, there is provided an image forming method, comprising the steps of:

a) uniformly supplying a liquid developer onto a surface of a photo-conductive substance by a supply member to which a voltage identical in polarity with the charge of toner contained in the liquid developer is applied to form a liquid developer layer;

b) selectively exposing said photo-conductive substance from the upside of the liquid developer layer in accordance with image information to weaken an adhesion of toner contained in the liquid developer in an exposed region of the photo-conductive substance to said photo-conductive substance;

c) attracting and recovering the toner weakened in adhesion by a removing member to which a voltage opposite in polarity to the charge of the toner is applied; and d) transferring an image developed by the liquid developer which remains on the surface of the photo-conductive substance without being recovered.

BRIEF DESCRIPTION OF THE DRAWINGS

These and other objects, features and advantages of this invention will become more fully apparent from the following detailed description taken with the accompanying drawings in which.

DETAILED DESCRIPTION OF THE PRFERRED EMBODIMENTS

Now, a description will be given in more detail of preferred embodiments of the present invention with reference to the accompanying drawings.

Figure 1:
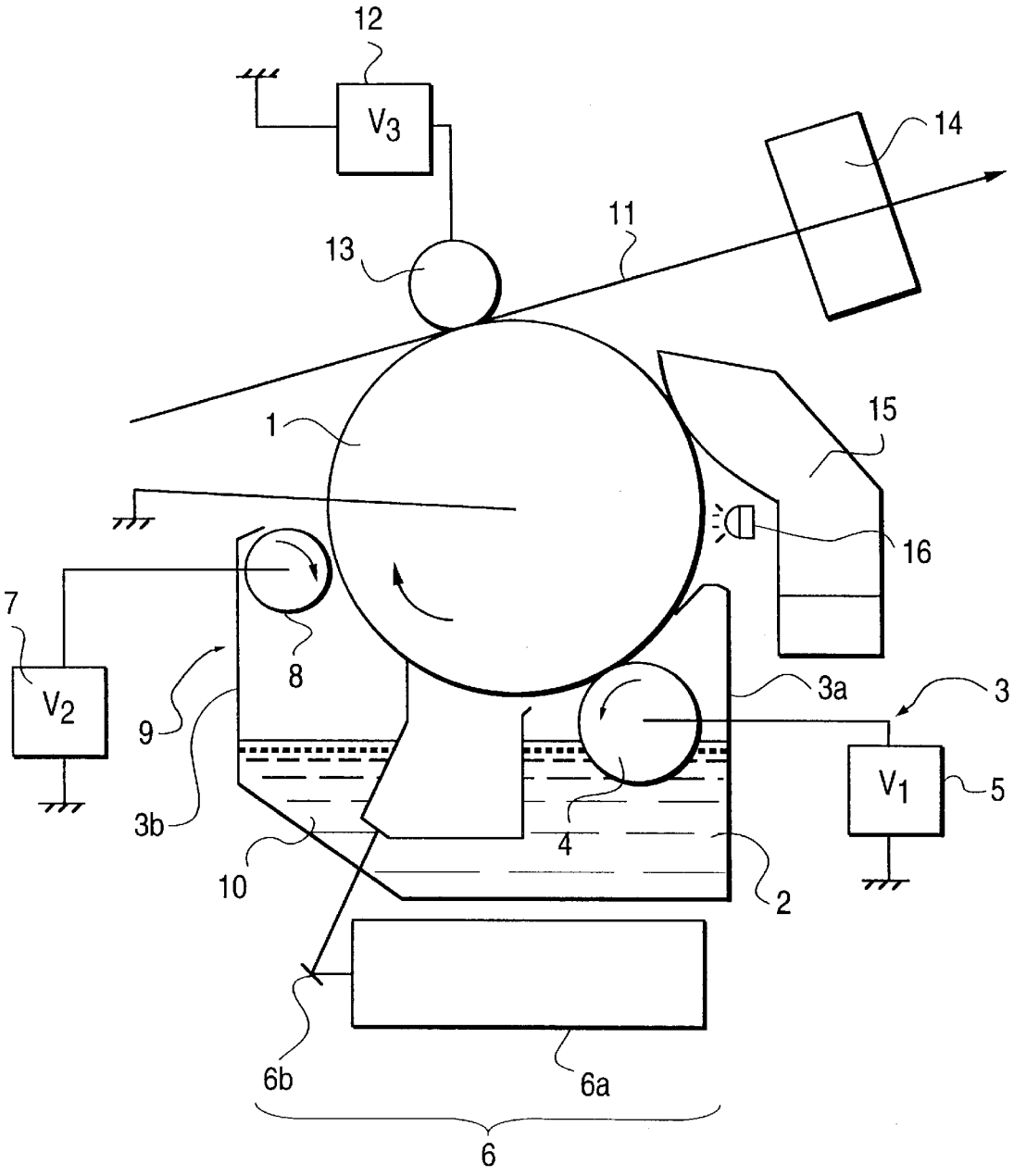
FIG. 1 is a schematic diagram showing the structure of an image fcming apparatus according to a first embodiment of the present invention.

As shown in FIG. 1, an image forming apparatus according to a first embodiment of the present invention includes a photosensitive drum 1 which is grounded and constitutes a photo-conductive substance, a uniform, supply section 3 that uniformly supplies a liquid developer 2 to the photosensitive drum 1, a transfer roller 13, a fixing section 14 and a removal section 15. The uniform supply section 3 includes a case (vessel) 3*a* for accommodating the liquid developer 2, a supply roller 4 which rotates while being abutted against the photosensitive drum 1 and is made of a conductive urethane foam or the like, and a power supply 5 that applies a voltage V1 identical in polarity with the charge of toner in the liquid developer 2 to the supply roller 4. The supply roller 4 is disposed within the vessel 3*a* and rotates by a drive mechanism not shown in a direction indicated by an arrow in FIG. 1. The liquid developer 2 which has been supplied by the supply roller 4 uniformly adheres to the surface of the photosensitive drum 1.

The exposure unit 6 includes a laser light source 6*a* for selectively exposing the photosensitive drum 1 in accordance with the image information, and a reflection mirror 6*b* that reflects a laser beam from the laser light source 6*a* to irradite it onto the photosensitive drum 1. The laser beam from the exposure unit 6 is irradiated onto the photosensitive drum 1 after the liquid developer 2 adheres to the photosensitive drum 1 due to the supply roller 4.

The conductive removing roller 8 selectively removes the liquid developer 2 existing on the photosensitive drum 1 after the selective exposure of the photosensitive drum 1 by the exposure unit 6. The removing roller 8 is disposed apart from the photosensitive drum 1 at a predetermined interval but close to the latter, and rotates in a direction indicated by an arrow in the figure. During removal, an output voltage V2 is applied to the removing roller 8 from a power supply 7. In this situation, the removing roller 8 attracts the liquid developer on the photosensitive drum 1 due to an electric field. The liquid developer as attracted gets dropped into the recovery vessel 3*b* from zhe removing roller 8 by a brush not shown or the like and then accumulated. The recovery vessel 3*b* is coupled to the vessel 3*a* through a coupling section 10 in such a manner that the liquid developer as recovered is used for supply to the photosensitive drum 1 as it is. The removing roller 8, the power supply 7 and the recovery vessel 3*b* constitute a selective removing section 9.

The transfer roller 13 transfers an image which is formed on the surface of the photosensitive drum 1 and developed by the liquid developer 2 to a recording medium 11 such as a sheet, etc. The transfer roller 13 rotates while being applied with an output voltage V3 from a power supply 12. In order to make transfer of the developed image excellent, the surface of the transfer roller 13 is formed of a conductive elastic member. The fixing section 14 heats and fixes the image which has been developed by the liquid developer and transferred onto the recording medium 11.

The removal section 15 includes a cleaner blade that removes the residual developer that has remained on the surface of the photosensitive drum 1 after transfer of the developed image by the transfer roller 13. A residual electric charge eliminating light source 16 is formed of a cold cathode tube, an LED lamp array or the like which is disposed upstream of the uniform supply section 3 with respect to the photosensitive drum 1, for uniformly irradiating a light onto the surface of the photosensitive drum 1 to eliminate the residual electric charge therefrom.

The liquid developer 2 is made of a carrier liquid, toner grains, a coloring material, a charge control agent and an image stabilization conditioner. The carrier liquid is generally a paraffin liquid agent mixed material, but particularly limited thereto, if it is a material that can stably charge-diffuse the toner grains and is hiah in electric resistance and low in dielectric constant. The toner grains are made of a charge control agent that mainly contains a thermoplastic resin or high polymer grains of 0.1 to several $\mu$m having a coloring material. The image stabilization conditioner is added for improving the diffusion property, the uniform supply property and the transfer property of the toner grains. In this example, the toner grains are positively charged. In this case, the output of the power supply 5 is set to a plus polarity (V1 volt), the output of the power supply 7 is set to a minus polarity (V2 volt), and the output of the power supply 12 is set to a minus polarity (V3 volt). For example, V1=800 (V), V2=−100 (V) and V3=−900 (V).

It should be noted that there may be applied a case in which the toner grains are negatively charged, the output of the power supply 5 is set to a minus polarity (−V1 volt), the output of the power supply 7 is set to a plus polarity (−V2 volt), and the output of the power supply 12 is set to a plus polarity (−V3 volt).

Figure 2:
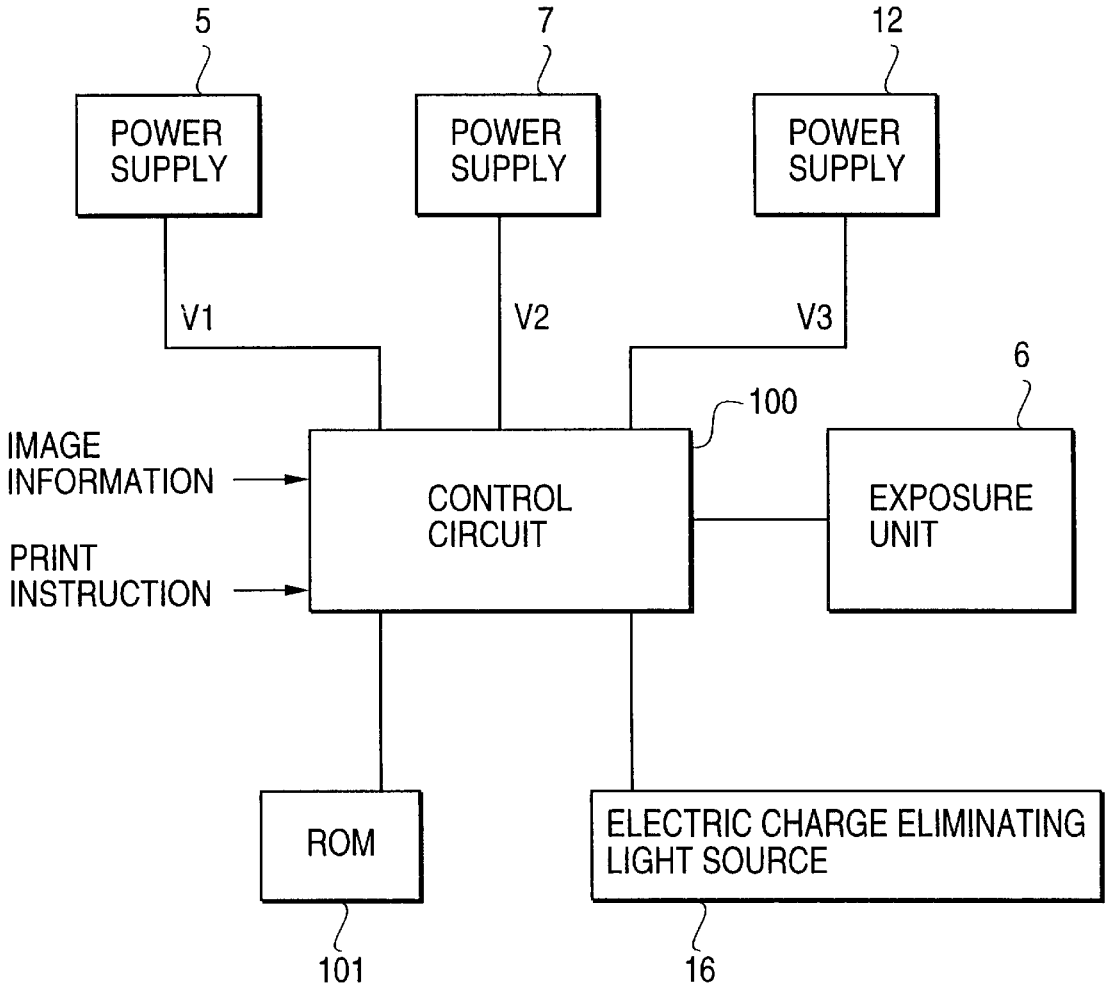
FIG. 2 is a block dtagranL showing an electric circuit system of the image forming apparatus snown in FIG. 1.

FIG. 2 is a block diagram showing an electric circuit system of the image forming apparatus shown in FIG. 1. In the figure, the power supplies 5, 7 and 12, the exposure unit 6 and the electricity eliminating light source 16 are controlled by a control circuit 100, respectively. The control circuit 100 also controls the rotation of the photosensitive drum 1 and the fixing by the fixing section 14 shown in FIG. 1. whose controls are executed on the basis of program stored in a ROM 101. Upon supply of a print instruction fron the external, the control circuit 100 starts the print operation of image information on the basis of the program stored in the ROM 101, Subsequently, the operation of the image forming apparatus shown in FIG. 1 will be described.

Upon starting the operation of the image forming apparatus in response to a print instruction, the control circuit 100 shown in FIG. 2 executes the control of the print start. With this execution, the photosensitive drum 1 and the respective roller members 4, 8 and 13 rotate, and the electricity eliminating light source 16 is turned on.

The liquid developer 2 is supplied to the surface of the photosensitive drum 1 which has been cleaned and electrically eliminated by the removal section 15 and the residual electrric charge eliminating light source 16 by the supply roller 4 to which the output voltage V1 (800(V)) is applied from the power supply 5. In this situation, the liquid developer 2 is allowed to adhere onto the surface of the photosensitive drum 1 by an electric field formed between that surface and the surface of the supply roller 4 in such a manner that toner grains (positive polarity) adhere to the photoreceptor surface side, and the carrier liquid adheres to the supply roller side. In this situation, most of the carrier liquid returns to the vessel 3*a* of the uniform supply section 3 with the rotation of the supply roller 4.

Negative charges opposite in polarity to the toner grains are induced onto the surface of the photosensitive material of the photosensitive drum 1 through the uniformr supply process.

The photosensitive drum 1 to the surface of which the liquid developer 2 is supplied and adheres by passing the uniform supply section 3 is image-exposed by the exposure unit 6 that selectively conducts exposure in accordance with the image information. This exposure is controlled by the control circuit. 100. The negative charges induced in the photosensitive material of the photosensitive drum 1 are neutralized by the charge carriers generated in the photosensitive mrterial by exposure. With this, an adhesion of the toner grains existing on the exposed portion to the photosensitive drum 1 is weakened, and at this time, an electrostatic latent image is formed on the liquid developer layer on the surface of the photosensitive drum 1 due to the strength of the adhesion of the toner grains.

In the liquid developer, the toner grains are dispersed in the carrier liquid, and the diffusion density is 30% or less at the maximum because the grain diameter is small, and the thickness of the liquid developer layer is 1 mm or less. Therefore, because the carrier liquid per se is achromatic and transparent, the exposure light from the exposure unit 6 transmits the liquid developer layer and arrives at the surface of the photosensitive drum 1.

Then, in the selective removing section 9, the toner grains which is weakened in electrostatic adhesion to the surface of the photosensitive drum 1 (toner grains on the exposed portion) adheres to the removing roller 8 to which the power supply output V2 (−100 (V)) from the power supply 7 is applied. At this time, the negative charges which are induced on the surface of the photosensitive drum 1 which is not exposed is sufficiently lower than −100 (V) (nearly −700 (V)) so that the toner grains (positive polarity) on the surface of the photosensitive drum 1 which is not exposed is not drawn apart from that portion by the removing roller 8. The toner grains that have adhered to the removing roller 8 are scraped off into the recovery vessel 3*b* by a brush not shown, etc.

A developed image is formed by the liquid developer on the surface of the photosensitive drum 1 that has passed through the selective removing section 9. On the other hand, the liquid developer which has been recovered by the selective removing section 9 returns to the vessel 3*a* of the uniform supply section 3 from the recovery vessel 3*b* through the coupling section 10 and is then recycled.

Then, the transfer roller 13 transfers the developed image to the recording medium 11 which has been conveyed in synchronism with the rctation of the photosensitive drum 1.

During transfer, an electric field more intense than the electric field formed in the selective removing section 9 is formed between the transfer roller 13 to which the output voltage (−900 TV)) is applied from the power supply 12 and the photosensitive drum 1. With this, the developer in the image section is transferred to the sheet side.

After transfer has been completed, the recording medium 11 is heated by the fixing section 14 so that the image is fixed onto the recording medium, and then outputted. On the other hand, while the photosensitive drum 1 rotates, the liquid developer and others which remain on the surface thereof are rewoved by the remqcval section 15, and electricity on the surface of the photosensitive drimi is eliminated so that irregularity of charges is remolded by the residual electric charge eliminating light source 16. In this way, image formation is progressed.

In this embodiment, there is shown an example in which the photosensitive drum 1 is used as thne photo-conductive substance and cyclically used. However, a sheet-shaped or belt-shaped photo-conductive substance may be used so that an image is fixed directly onto the photo-conductive substance per se and outputted.

Figure 3:
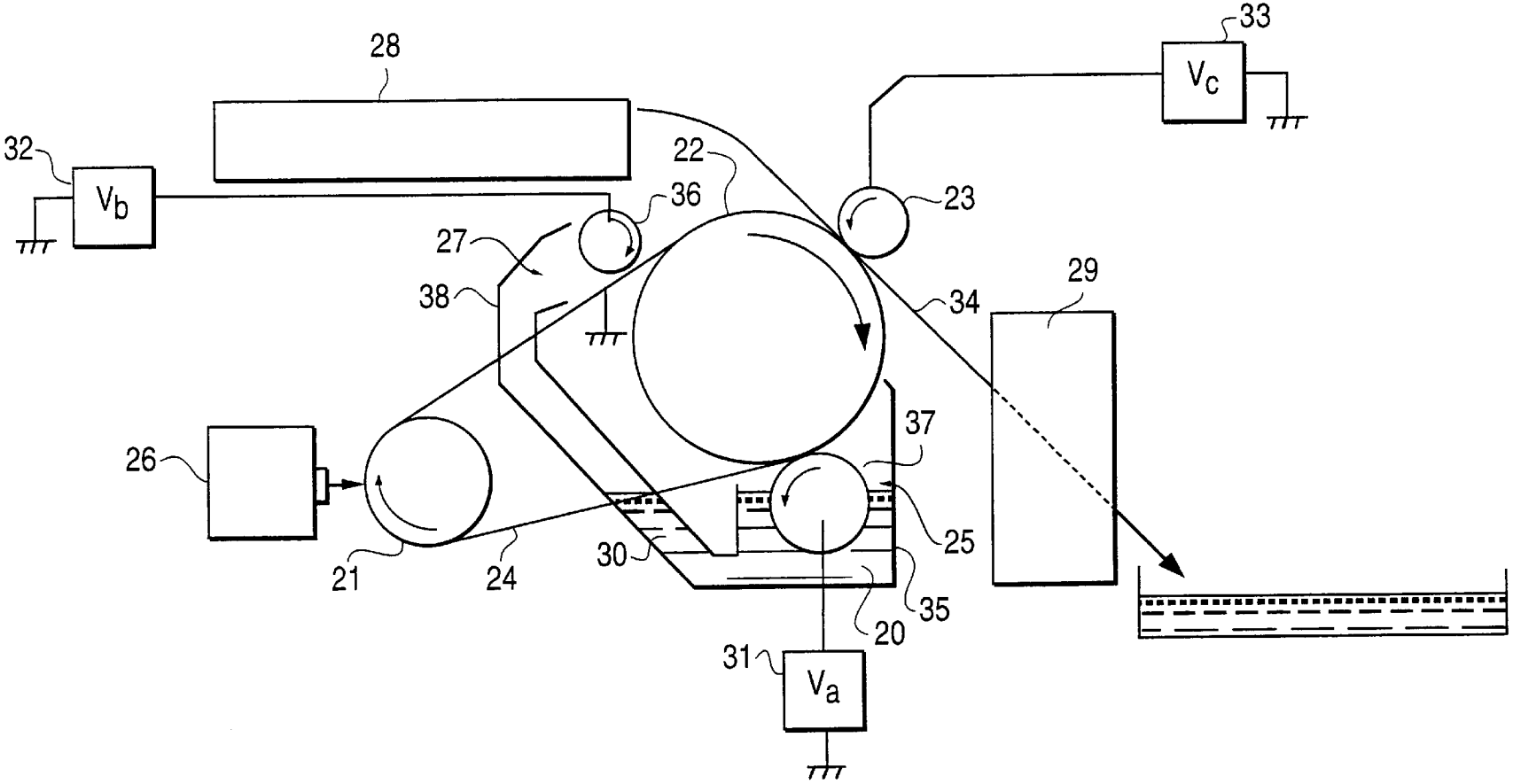
FIG. 3 is a schematic diagram showing the structure of an image forming apparatus according to a second embodiment of the present invention.

FIG. 3 is a structural diagram showing an image forming apparatus according to a second embodiment of the present invention.

In the figure, the image forming apparatus is made up of drive rollers 21 and 22, a photosensitive belt 24 which is rotatably supported by those drive rollers 21 and 22, a uniform supply section 25 which is disposed in the vicinity of the drive roller 22 for recovering a liquid developer 20 resident on the photosensitive belt 24 after transfer and conducting uniform suppsly, an LED head 26 which is a latent image forming means which selectively conducts exposure on the photosensitive belt 24, and a selective removing section 27 that recovers the liquid developer on a non-image section from the surface of the belt-shaped photosensitive body after the formation of the latent image.

The uniform supply section 25 includes a vessel 35 that accommodates the liquid developer 20, a supply roller 37 and a power supply 31. The supply roller 37 has both the functions of supply of the liquid developer and removal of the resident developer after transfer. An output Va of a power supply 31 which is connected to the supply roller 37 is superimposed on a.c. for removing the resident liquid developer on the belt-shaped photosensitive body and removing the irregularity of the residual charges after transfer.

The LED head 26 is disposed in the vicinity of the drive roller 21 and forms an electrostatic latent image on the photosensitive belt 24 put on the drive roller 21.

The selective removing section 27 is disposed opposite to the uniform supply section 25 with respect to the photosensitive belt 24. The selective removing section 27 includes a recovery vessel 38, a removing roller 36 and a power supply 32. The recovery vessel 38 is coupled to the vessel 35 of the uniform supply section 25 through a coupling section 30. The recovery vessel 38 can move the liquid developer as recovered as it is to vessel 35 because it is above the vessel 35. The removing roller 36 is applied with an output voltage Vb of the power supply 32 and disposed close to the belt-shaped photosensitive body 24 so as to be rotatably driver. The principle of removal of the liquid developer by the removing roller 36 is identical with the removal by the removing roller 8 shown in FIG. 1. The developer recovered in the recovery vessel 38 is accumulated in the vessel 35 and recycled.

The transfer roller 23 transfers a developed image on the belt-shaped photosensitive body 24 onto a recording medium 34 which is conveyed from a sheet supply section 28. A fixing section 29 fixes the image on the recording medium 34 by heating.

A relation of a voltage Vc applied to the transfer roller 23 by a power supply 33, a voltage Vb and the polarity of the toner grains is set to be identical with the relation of the voltage V3, V2 and the polarity of the toner grains in the foregoing embodiment.

Figure 4:
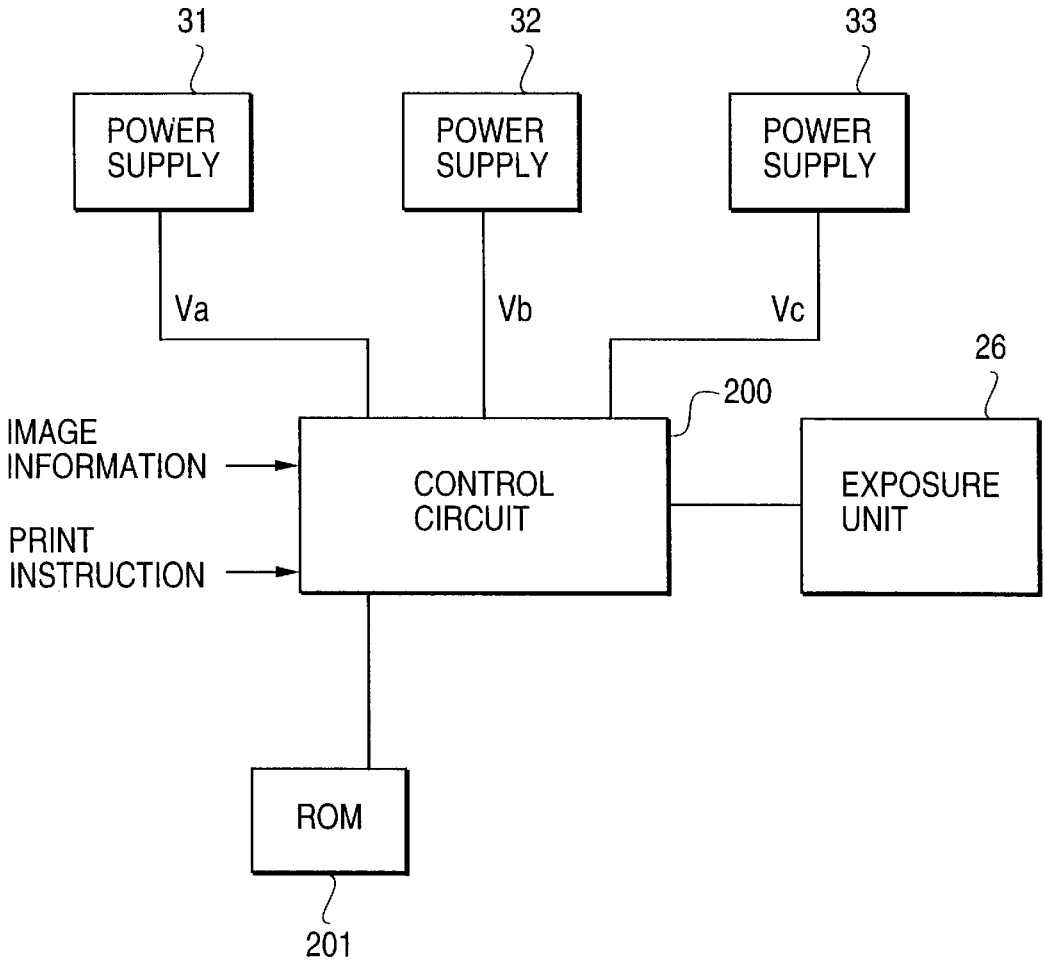
FIG. 4 is a block diagram showing an electric circuit system of the image forming apparatus shown in FIG. 3.

What is different from the foregoing embodiment are that the drive rollers 21 and 22 are disposed for use of the photosensitive belt 24 as the photo-conductive substance, that the uniform supply section 25 has a removal function, and that not the laser beam scanning system but the LED head 26 is used as the electrostatic image forming reaans. The description of the liquid developer 20 gill be omitted because it is the saire as that in the foregoing embodiment FIG. 4 is a block diagram showing an electric circuit system of an image forming apparatus shown in FIG. 3. In the figure, the power supplies 31, 32 and 33 and the LED head 26 are controlled by a control circuit 200, respectively. The control circuit 200 also controls the rotation of the drive rollers 21 and 22 and the fixing by the fixing section 29 shown in FIG. 3. Those controls are executed on the basis of program stored in a ROM 201. Upon supply of a Print. instruction from the external, the control circuit 200 starts the print operation of image information on the basis of the program stored in the ROM 201.

Subsequently, the operation of the image forming apparatus thus constituted according to the second embodiment will be described.

Upon starting the operat-on of the image Lormation (a print instruction to the control circuit 200), The belt-shaped photosensitive body 24 rotates with the rotation of the drive roller 21. Then, an output voltage Va (800 (V)) of the supply voltage 31 is applied to the supply roller 37 of the uniform supply section 25 so that the supply roller 37 removes the liquid developer resident on the belt-shaped photosensitive body 24 and the irregularity of charges on the belt-shaped photosensitive body 24 after transfer, and also uniformly supplies the liquid developer to the belt-shaped photosensitive body.

The supply voltage Va where a bias voltage identical in polarity with the charge of the charged toner grains is superimposed on an a.c. voltage of a level that partially causes the reverse of polarity is applied to conduct. the removal of the residual developer and the uniform supply at the same time.

In this uniform supply section 25, likewise as the foregoing embodiment, the liquid developer 20 is allowed to adhere onto the surface of the photosensitive belt 24 by an electric field formed between the surface of the photosensitive belt 24 and the surface voltage of the supply roller in such a manner that toner grains adhere to the surface side of the photosensitive belt, and the carrier liquid adheres to the supply roller side. In this situation, most of the carrier liquid returns to the vessel 35 that accommodates the liquid developer of the uniform supply section 25 with the rotation of the supply roller 37.

Charges opposite in polarity to the toner grains are induced onto the surface of the photosensitive material of the photosensitive belt 24 which is in contact with the liquid developer in photosensitive drum 1 with the formation of the liquid developer layer on the surface of the photosensitive belt.

The photosensitive belt 24 is selectively exposed by the LED head 26 fron the upside of the liquid developer layer in accordance with image information, and the charge induced onto the surface of the photosensitive material are neutralized by the carriers (excitons) generated in the photosensitive material by the exposure. With this neutralization, an adhesion of the toner grains existing on the exposed portion to the photosensitive material is weakened.

In the above way, an electrostatic latent image is formed within the liquid developer layer on the photosensitive belt 24.

Thereafter, the removing roller 360 to which the output voltage Vb (−100 (V)) of the power supply 32 is applied rotates close to the belt-shaped photosensitive body 24 in the selective removing section 27 such that the toner grains weakened in the foregoing adhesion is recovered from the surface of the photosensitive body. In other words, the toner grains (toner grains on the exposed portion) which are weakened in the electrostatic adhesion to the surface of the photosensitive belt 24 adhere to the removing roller 36 to which the power supply output Vb (−100 (V)) is applied from the power supply 32. At this time, the negative charges which are induced on the surface or the photosensitive belt 24 which is not exposed is sufficiently lower than −100 (V) (nearly −700 (V)) so that the toner grains (positive polarity) which are not exposed are not drawn apart from that portion by the removing roller 36. The toner grains that have adhered to the removing roller 36 are scraped off into the recovery vessel 38 by a brush not showin, etc.

In the above way, an image is formed by the liquid developer on the surface of the photosensitive belt, and transferred to a recording medium sheet which is conveyed in synchronism with the drive of the photosensitive belt by the sheet supply section 28 by transfer roller 23 to which output voltage of power supply 33 VC (−900 (v)) is applied. The sheet passes through the heat fixing section 29 in such a manner that the image is fixed onto the sheet and then outputted.

On the other hand, the photosensitive belt 24 is conveyed to the uniform supply section 25 having the removal function and used for succeeding image formation.

With use of the photosensitive belt 24, different from a case of the photosensitive drum, the respective components can be arranged with the free degree and arranged above the uniform supply section 25 with ease.

The present invention is not limited to or by the above embodiments, and various embodiments are implemented within the spirit of the present invention.

As was described above, in the present invention, since the supply device supplies the liquid developer to the photo-conductive substance of the photosensitive drum or belt prior to the electrostatic latent image forming process, it is unnecessary to selectively supply the liquid developer as in the prior art. Therefore, with the simple mechanism in which the supply device is brought in direct contact with or close to the photo-conductive substance, the uniform charge and the uniform supply of the liquid developer can be performed, thus being capable of simplifying the construction of the apparatus. Also, the image noises occurring when selectively supplying the liquid developer can be reduced. This is because in the present invention, the image section to which the liquid developer adheres is formed by exposure after uniform supply of the liquid developer, and the accuracy of the image section (resolution) is not determined by the developer supply section but by the exposure unit. In general, in the developing unit employing the liquid developer, it is difficult to enhance the accuracy of the developer supply section when supplying the liquid developer to the photo-conductive substance, and therefore it is effective that the developed image is formed in the exposure unit high in accuracy, Also, the supply device is superimposed on the a.c. voltage, whereby it can provide the functions of removal section and the electricity eliminating section together with the supply of the developer. Thus, the construction of the apparatus can be further simplified.

In particular, in the embodiment shown in FIGS. 1 and 3, the selective removing section is communicated with the supply section, and the selective removing section is disposed above the supply section, thereby being capable of circulating the liquid developer with a simple construction.

As described above, because the construction of the apparatus is simplified, the apparatus can be downsized and the costs can be reduced.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

a photo-conductive substance;

a supply device for uniformly supplying a liquid developer onto a surface of said photo-conductive substance;

a latent image forming unit for selectively exposing said photo-conductive substance after supply of said liquid developer to form an electrostatic latent image which is weakened in adhesion of the liquid developer to said photo-conductive substance;

a selective removing device for removing, said liquid developer which is weakened in adhesion by said latent image forming unit, from the surface of said photo-conductive substance due to an electric field, wherein said selective removing device has a path through which the liquid developer as removed is returned to said supply device, and wherein the selective removing device is separated at a distance from the supply device through a path of an accommodating vessel for accommodating the liquid developer removed by the removing device;

a transfer device for transferring, an image developed by the liquid developer which remains on the surface of said photo-conductive substance after removal of the liquid developer by the selective removing device, to a recording medium.

2. An image forming apparatus as claimed in claim 1, further comprising a removal device for removing from the surface of said photo-conductive substance the liquid developer that has remained on the surface of said photo-conductive substance after transfer of the image by said transfer device.

3. An image forming apparatus as claimed in claim 2, wherein said removal device eliminates electric charge on the surface of said photo-conductive substance which has passed through said transfer device.

4. An image forming apparatus as claimed in claim 2, wherein said supply device serves also as said removal device.

5. An image forming apparatus as claimed in claim 1, wherein said selective removing device is located above said supply device.

6. An image forming apparatus as claimed in claim 1, wherein said supply device includes an accommodating vessel for accommodating the liquid developer, a supply roller that rotates while being abutted against said photo-conductive substance, and a circuit for applying a voltage identical in polarity with the charge of toner contained in said liquid developer to said supply roller.

7. An image forming apparatus as claimed in claim 6, wherein said selective removing device includes a removing roller that attracts and removes the liquid developer by an electric field which is located at a position corresponding to the electrostatic latent image on said photo-conductive substance, a circuit for applying a voltage opposite in polarity to the charge of said toner to said removing roller, and a recovery vessel for accumulating the liquid developer attracted by said removing roller, wherein said accommodating vessel of said supply device and said recovery vessel of said selective removing device are coupled to each other so that the liquid developer as removed is returned to said accommodating vessel, wherein said circuit supplies to said supply roller a voltage, wherein the voltage supplied to the supply roller is a bias voltage identical in polarity with the charges of said toner superimposed on an a.c. voltage.

8. An image forming apparatus as claimed in claim 6, wherein said supply device serves also as said removal device, and said circuit supplies to said supply roller a voltage, wherein the voltage applied to the supply roller is a bias voltage identical in polarity with the charges of said toner superimposed on an a.c. voltage of a level that partially generates the reverse of polarity.

9. A method of forming an image on a recording medium using a liquid developer, comprising the steps of:

uniformly supplying a liquid developer onto a surface of a photo-conductive substance any a supply member to which a voltage identical in. polarity with the charge of toner contained in said liquid developer is applied to form, a liquid developer layer;

selectively exposing said photo-conductive substance from the upside of said liquid developer layer in accordance with image information to weaken an adhesion of toner contained in the liquid developer in an exposed region of the photo-conductive substance to said photo-conductive substance;

attracting and removing the toner weakened in adhesion by a removing member to which a voltage opposite in polarity to the charge of the toner is applied; and transferring an image developed by the liquid developer which remains on the surface of said photo-conductive substance without being removed to said recording medium.

10. A method of forming an image as claimed in claim 9, wherein said developed image is transferred to said recording medium by a transfer device to which a voltage larger in absolute value than a voltage which is applied to the removing member is applied.

11. A method of forming an image as claimed in claim 10, wherein the liquid developer transferred onto said recording medium is fixed onto the recording medium by heat after transfer, and the liquid developer resident on the photo-conductive substance after transfer is removed.

12. A method of forming an image as claimed in claim 11, wherein the voltage applied to the supply member is a bias voltage identical in polarity with said toner superimposed on an a.c. voltage.

* * * * *